US005197802A

United States Patent [19]

Miller et al.

[11] Patent Number: 5,197,802

[45] Date of Patent: Mar. 30, 1993

[54] MIXING APPARATUS

[75] Inventors: William A. Miller, Buffalo Grove; Daniel E. Molter, Schaumburg, both of Ill.

[73] Assignee: Fluid Management Limited Partnership, Wheeling, Ill.

[21] Appl. No.: 762,325

[22] Filed: Sep. 18, 1991

[51] Int. Cl.[5] ..... B01F 9/00

[52] U.S. Cl. ..... 366/217; 366/605; 192/18 R

[58] Field of Search ..... 366/217, 209, 605, 208, 366/219; 248/128, 130, 131; 100/289; 269/242, 74, 82; 192/18 R, 19

[56] References Cited

U.S. PATENT DOCUMENTS

| | | | |
|---|---|---|---|
| 3,880,408 | 4/1975 | Karjalainen | 366/217 |
| 4,235,553 | 11/1980 | Gall | 366/208 |
| 4,445,782 | 5/1984 | Sparrow, Jr. | 366/605 |
| 4,497,581 | 2/1985 | Miller | 366/208 |
| 4,588,302 | 5/1986 | Pizzi | 366/209 |
| 4,789,245 | 12/1988 | Morbeck | 366/217 |
| 4,834,548 | 5/1989 | Tempel et al. | 366/208 |
| 5,035,601 | 7/1991 | Lin | 366/217 |

FOREIGN PATENT DOCUMENTS

| | | | |
|---|---|---|---|
| 0093091 | 11/1983 | European Pat. Off. | 366/219 |
| 2809513 | 9/1979 | Fed. Rep. of Germany | 366/605 |
| 2725080 | 12/1981 | Fed. Rep. of Germany . | |

*Primary Examiner*—Philip R. Coe
*Assistant Examiner*—Randall Edward Chin
*Attorney, Agent, or Firm*—Fitch, Even, Tabin & Flannery

[57] ABSTRACT

A mixing apparatus for pulverulent materials includes guide rods carrying a pair of opposed pressure plates having centers aligned along a common axis of rotation. A tubular frame encloses a three-dimensional volume disposed about said guide rods and pressure plates to shield the guide rods and pressure plates from inadvertent contact, and to mount an electric motor. The pressure plates are locked in position by a transmission shaft which is geared to a lead screw which engages the pressure plates.

16 Claims, 5 Drawing Sheets

MIXING APPARATUS

BACKGROUND OF THE INVENTION

1. Field of the Invention

The present invention relates to apparatus for mixing flowable materials including pulverulous material such as paints. More particularly, the invention relates to mixing apparatus which shakes or mixes the contents of a closed container simultaneously along different axes.

2. Description of the Related Art

Significant advances in mixing apparatus for pulverulous materials such as paints and other coatings has been provided in the U.S. Letters Pat. No. 4,235,553. Disclosed is an apparatus which mixes the contents of a closed container using a gyroscopic forces.

Patentschrift DE 27 25 080 CU also discloses a mixer apparatus which moves a closed container simultaneously among different axes. The mixing apparatus is enclosed with a housing, and includes opposed clamping plates for compressing a closed container therebetween, to secure the container during the mixing operation. The clamping plates are operated by manually engageable crank means which extend to the front of a cabinet enclosure. The cabinet is constructed using sheet material which is attached to an L-shaped structure comprising a horizontal base and a vertical backing member, both of an open framework construction using tubular steel.

Mixing apparatus of the above-described types have found application in the paint industry where a tinting material is added to a container filled with a base paint material. Subsequent to pouring the tinting material into the base paint, it is necessary to stir the mixture very thoroughly in order to obtain a paint of uniform color. Mixing operations are typically carried out in a paint factory where the paint mixture is manufactured, but as the containers of blended composition are set aside during storage or transport, certain components of the mixtures tend to settle, and a subsequent mixing operation is sometimes required before the compositions are ready for use. Accordingly, it has been found desirable to provide mixing apparatus throughout the distribution chain of a paint supplier, including retail locations. In order to be suitable for these applications, mixing apparatus must be relatively compact and lightweight and must be easy to service even by untrained personnel. For example, mixing apparatus which is belt-driven occasionally requires replacement of the drive belts, such operation usually being considered a routine maintenance activity. It is important, for example, that this type of operation be quickly and easily carried out by store personnel, even those at a retail location who are generally unfamiliar with complex apparatus.

SUMMARY OF THE INVENTION

It is an object according to the present invention to provide mixing apparatus for mixing the pulverulous contents of a closed container.

Another object according to the present invention, is to provide mixing apparatus which is enclosed in a cabinet and which provides access outside of the cabinet for clamping the container to be mixed.

A further object according to the present invention, is to provide an improved locking arrangement for holding a container to be mixed within a mixing device, so that the container is securely retained during a mixing operation.

Yet another object of the present invention is to provide mixing apparatus of the above-described type which is quickly and easily serviced for routine maintenance operations, and which provides an improved motor mounting for use with a belt drive of the mixing apparatus.

These and other objects according to the present invention, which will become apparent from studying the appended description and drawings, are provided in a mixing apparatus for pulverulent materials having a forward end for loading items to be mixed and a rearward end, comprising:

guide rod means extending in a first plane;

first rotating means for rotating the guide rod means in the first plane;

a pair of opposed pressure plates having centers aligned along a common axis generally parallel to said first plane and passing generally through the centers of the pressure plates, said pressure plates carried on said guide rod means so as to be movable along said common axis;

second rotating means for rotating said pressure plates about the common axis;

tubular frame means enclosing a three dimensional volume disposed about said guide rod means and said pressure plates to shield the guide rod means and pressure plates from inadvertent contact, said tubular frame means including a back portion, at the rearward end of the apparatus, with an upper part protruding above said guide rod means and said pressure plates;

electric motor means for driving at least one of said first and said second rotating means; and mounting means for mounting said electric motor means at the upper part of the tubular frame means.

DETAILED DESCRIPTION OF THE PREFERRED EMBODIMENTS

Figure 1:
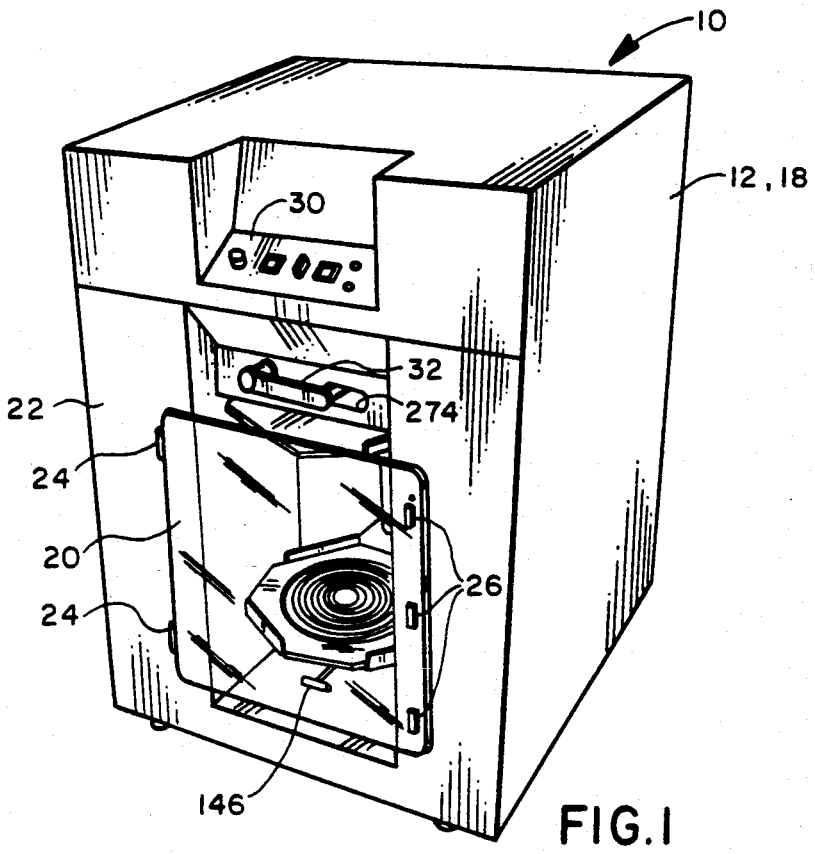
FIG. 1 is a perspective view of mixing apparatus according to principles of the present invention.

Referring now to the drawings, and initially to FIG. 1, mixing apparatus according to principles of the present invention is generally indicated at 10. Apparatus 10 includes an outer covering 12 of rigid sheet material, preferably a sheet metal. Referring additionally to FIG.

2, covering 12 cooperates with a tubular frame structure generally indicated at 16 to form a free-standing enclosure or cabinet 18. A rear panel 70 and a floor panel 72 are added to complete the enclosure, and if desired, may be secured to the side wall portions 40, 42 and the lower cross-member 46, so as to be incorporated in the overall frame structure 16. Alternatively, the frame structure 16 could be free-standing, that is, structurally complete, without requiring the rigidity afforded by plates 70, 72. The cabinet 18 includes an access door 20 mounted to a front wall 22 of the cabinet by hinges 24 and magnetic closure assemblies 26. A control panel 30 located on the exterior of cabinet 18 provides convenient control for components within the cabinet and also various annunciator means for indicating the status of those components to an operator of the apparatus. A handle 32 extends outside of cabinet 18, and, as will be seen herein, provides operation of the clamping plates for securing a container to be mixed within apparatus 10.

Figure 2:
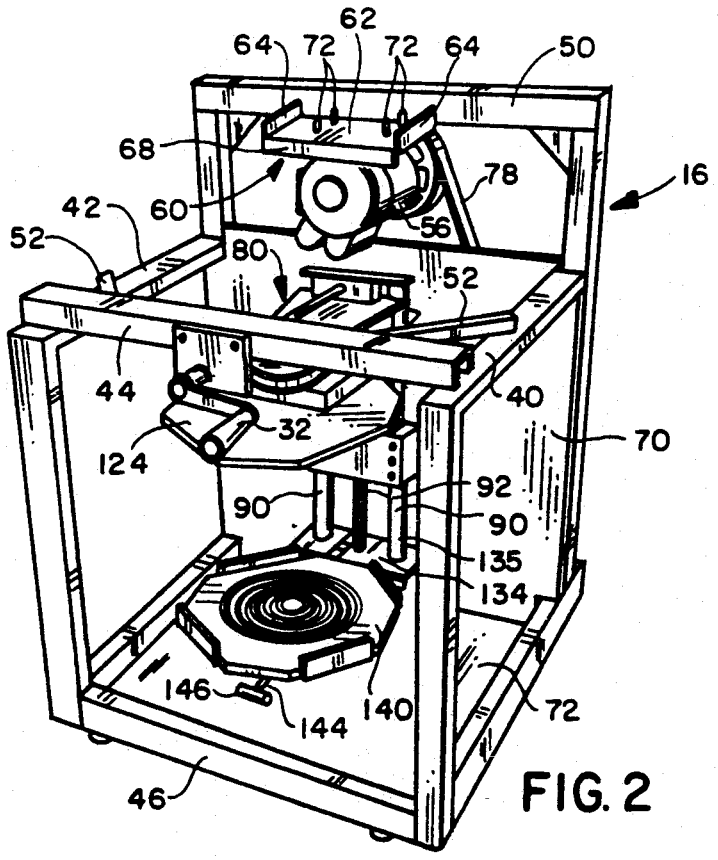
FIG. 2 shows the apparatus of FIG. 1 with the outer covering removed.
Figure 3:
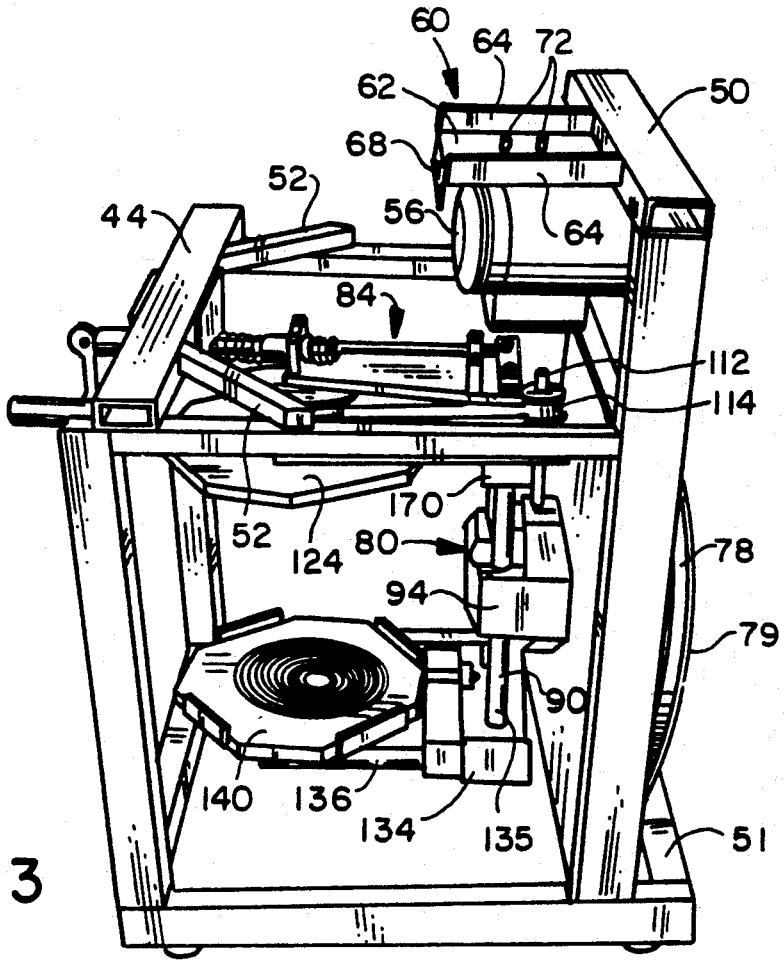
FIG. 3 is a perspective view of the arrangement of FIG. 2.

Referring to FIGS. 1 and 2, the frame structure 16 includes generally rectangular sidewalls 40, 42 of tubular metal construction, and upper and lower cross-members 44, 46. The rear portions of side members 40, 42 extend above the horizontal plane of front cross-member 44 and are joined together by a rear cross-member 50. Strut members 52 add rigidity at the upper forward corners of frame structure 16. Referring to FIG. 3, a rear, lower cross-member 51 extends between the side portions 40, 42.

Figure 6:
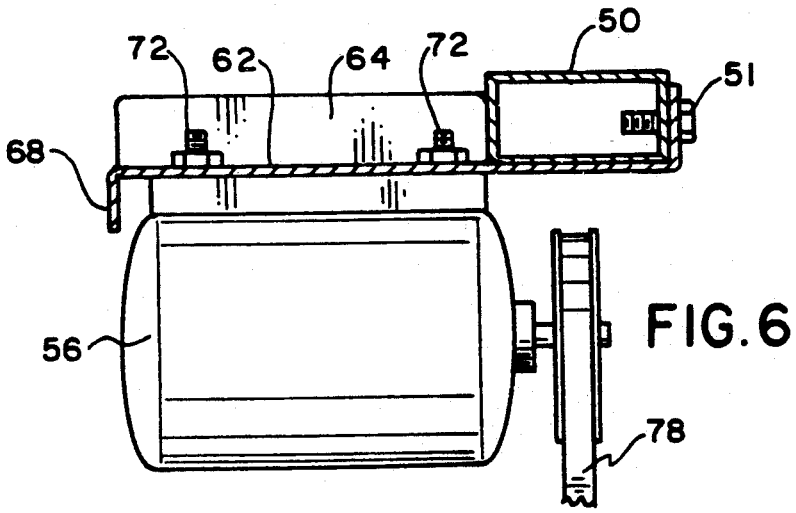
FIG. 6 is a fragmentary, side elevational view, partly in cross-section, of the motor mounting shown at the top of FIGS. 2 and 3.

The frame structure 16, generally speaking, has six sides and encloses an interior volume wherein various operating components of apparatus 10 are located. As can be seen in FIGS. 2 and 3, the majority of the operating components are located between sidewalls 40, 42. An electric motor 56 is mounted to the upper cross-member 50. According to one aspect of the present invention, a sheet metal bracket 60 is provided for the cantilever mounting of motor 56 from cross-member 50. The sheet metal bracket 60 includes a generally horizontal panel portion 62 which extends underneath cross-member 50, being secured thereto with a suitable fastening arrangement such as welding or the threaded fasteners 51 shown in FIG. 6, for example. The sheet metal bracket 60 further includes side walls 64 upwardly extending from panel portion 62. Preferably, the side walls 64 are also secured to the forward vertical surface of cross-member 50. The sheet metal bracket 60 further includes a downwardly-turned lip 68 at a forward end to add rigidity to the bracket, although the downwardly turned lip could be omitted, if desired. A rear panel 70 and a floor panel 72 are added to complete the enclosure, and if desired, may be secured to the side wall portions 40, 42 and the lower cross-member 46, so as to be incorporated in the overall frame structure 16. Alternatively, the frame structure 16 could be free-standing, that is, structurally complete, without requiring the rigidity afforded by plates 70, 72.

As can now be seen, the mounting bracket 64 is of a cantilevered construction, providing cantilevered support for the electric motor 64 which is secured to platform portion 62 with a plurality of threaded fasteners 72. The mounting bracket 60 has been found to provide a desirable resilient mounting for the electric motor 56, absorbing impulse shock when the motor picks up slack in a drive belt 78, which, as will be seen herein, drives the mixing mechanism generally indicated at 80, which, as will be seen herein, generally comprises guide rail means having a central hub 94 (see FIG. 3) for mounting a pair of guide rails 90 for rotation about a horizontal axis. A reduction in the wear of the bearings of motor 56 and in the wear of drive belt 78 are provided by the motor mounting.

Figure 4:
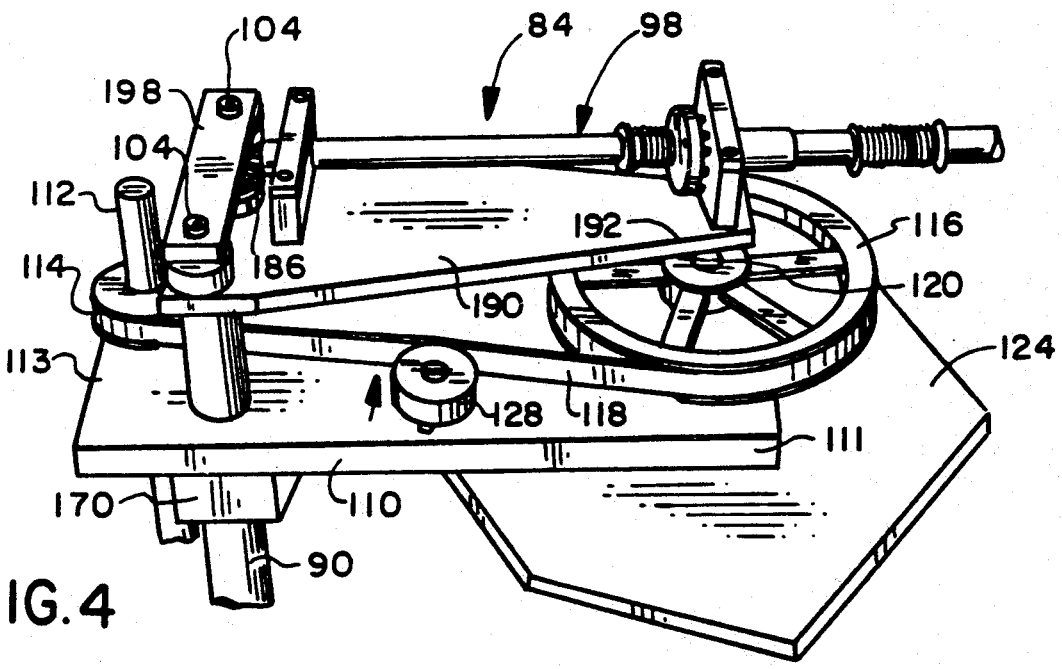
FIG. 4 is a fragmentary view shown on an enlarged scale of the locking mechanism located at the upper portions of FIGS. 2 and 3.
Figure 5:
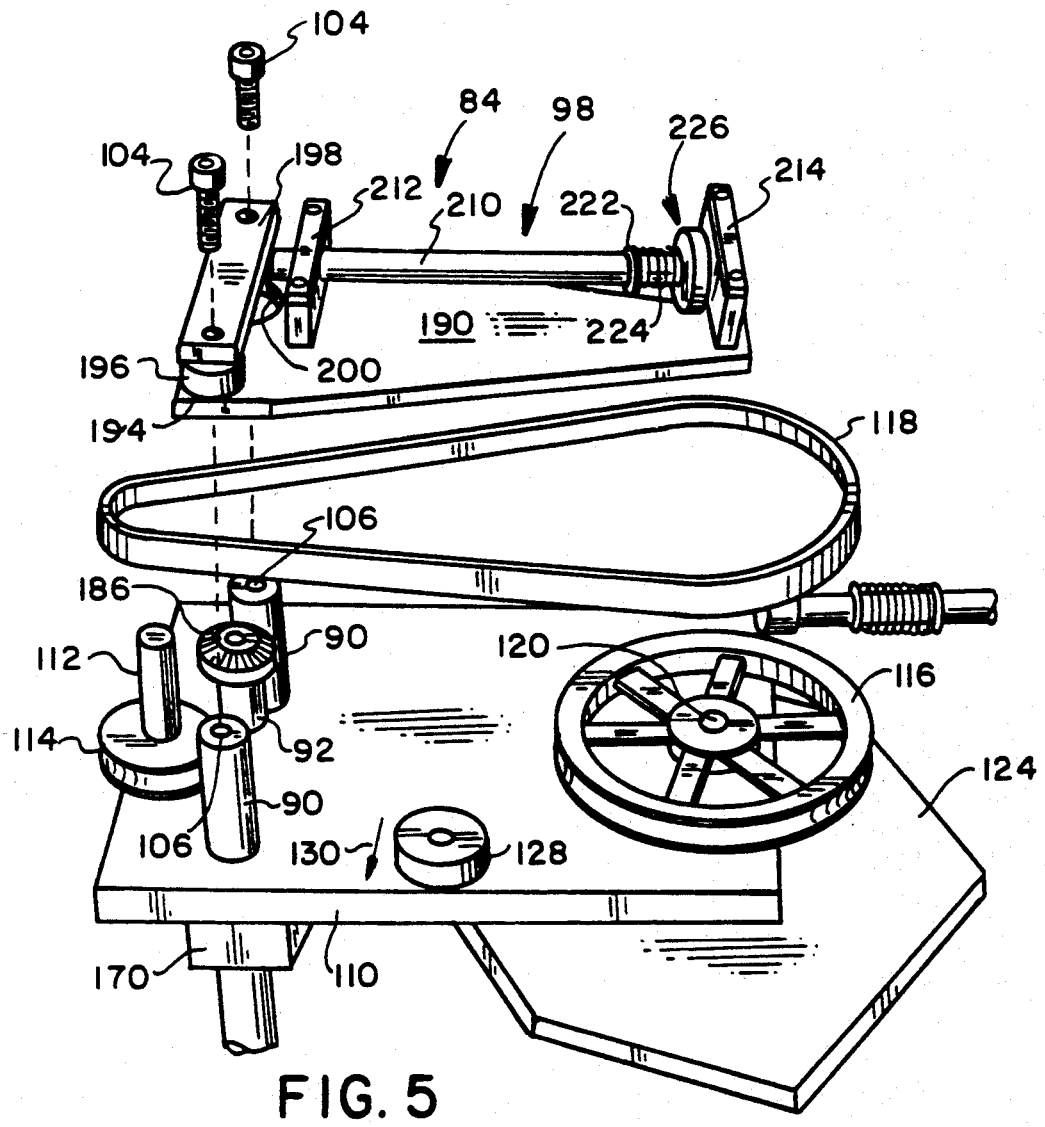
FIG. 5 is an exploded view of the arrangement of FIG. 4.

Referring now to FIGS. 2-4, an upper mechanism assembly is generally indicated at 84. The assembly receives support from a pair of cylindrical guide rails 90 which are disposed on either side of a double-ended lead screw 92 (FIG. 2). As will be seen herein, the guide rails 90 are mounted for rotation about a horizontal axis passing generally through the center of mounting hub 94 (FIG. 3). Assembly 84 includes a lock mechanism generally indicated at 98 mounted on an upper table 190 which receives support from the upper ends of guide rails 90. The upper table 190 is cantilevered from guide rails 90 and has a forward free end 192. As indicated in FIG. 5, the lock mechanism is secured to the upper ends of guide rails 90 by threaded fasteners 104 received in threaded bores 106 which extend to the upper free ends of guide rails 90. Additional features and operation of lock mechanism 98 will be described in greater detail herein.

Upper assembly mechanism 84 also includes a lower table 110 slidingly supported by guide rails 90, and spaced a distance below the upper free ends of the guide rails. The lower table 110 is cantilevered from the guide rails, and also has a forward free end 111 located generally below the forward free end 192 of upper table 190. A drive spindle 112 is mounted at the rearward end 113 of table 110 and extends to mounting hub 94 in which a gear drive is located for rotation, of spindle 112 about its central axis.

Pulleys 114, 116 are provided for drive belt 118. Pulley 114 is mounted to spindle 112, while pulley 116 is rotationally mounted to lower table 110 by a shaft 120 affixed to the center of upper clamping plate 124. Spindle 112 is driven by a gear system (not shown) within mounting hub and through pulley 114 drives belt 118 so as to spin upper clamping plate 124 about a secondary axis of rotation, corresponding to the central axis of shaft 120. An idler pulley 128 is provided for adjusting tension of drive belt 118, and facilitates the easy removal of the drive belt 118, as illustrated in FIG. 5. In order to service drive belt 118 for replacement, for example, the threaded fasteners 104 are removed and locking mechanism 98 is lifted from guide rails 90. The idler pulley 128 is then moved in the direction of arrow 130 and drive belt 118 is easily removed from the pulleys 114, 116. As can now be seen, the servicing of the drive belt 118 is quickly and easily accomplished with apparatus according to the present invention.

Figure 9:
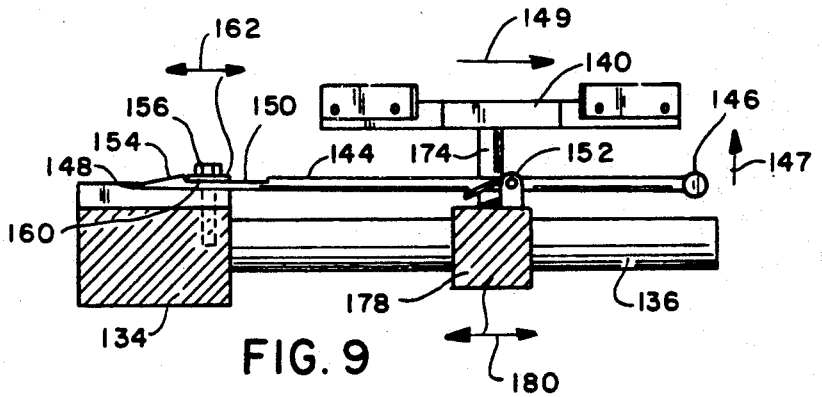
FIG. 9 is a fragmentary side elevational view, shown partly in cross-section, of the lower clamping plate assembly.

Referring now to FIGS. 3 and 9, an end member 134 is slidably supported a opposite end 135 of guide rails 90. A pair of sliding mans or support rails 136 extend forwardly from end member 134 in a generally horizontal direction. The support rails 136 are generally cylindrical and are cantilevered from end member 134. A turntable or lower clamping plate 140 is free to spin about its axis of rotation and therefore follows the spinning drive of the upper clamping plates 124 when a container is compressed between the clamping plates 124 and 140 during a mixing operation. With reference to FIG. 9, the lower clamping plate 140 is mounted for rotation on a stub shaft 174, which is mounted on a sliding carriage 178 for sliding movement back and forth in the direction of arrow 180. With reference to FIG. 2, the lower end of lead screw 92 is threadingly engaged with end member 134 and, as the lead screw is rotated in opposite directions, end member 134 and the components associated therewith (illustrated in FIG. 9) move back and forth along guide rails 90. Preferably, the lead screw 92 is double-threaded with threads on either side of hub 94 being of an opposite sense so that as the lead screw 92 is rotated both upper and lower clamping plates are moved simultaneously, either toward or away from each other.

As mentioned, the lower clamping plate 140 is mounted for sliding movement by support rails 136. This allows the lower clamping plate to be extended or slid forwardly of cabinet 18 by an operator so that a container to be mixed within apparatus 10 can be conveniently placed on top of the clamping plate 140 from a position immediately in front of cabinet 18. The lower clamping plate is then advanced in a rearward direction toward the back of apparatus 10 and, for reasons which will become apparent, it is important that the lower clamping plate 140, when fully retracted, is aligned with the axis of rotation of the upper clamping plate 124.

According to principles of the present invention, a lock is provided for the lower clamping plate 140 to fix it in position when fully retracted into cabinet 18. The present invention also provides an adjustment for the lower clamping plate lock, to bring the center of the clamping plate into accurate alignment with the center of the upper clamping plate 124.

As those skilled in the art will appreciate, larger size containers, such as five gallon cans, when filled with paint and especially when filled with heavier block filler materials, can give rise to significant values of momentum when the cans are accelerated during loading and unloading operations. It is generally preferred that the support rails 136 are mounted with ball-bearing mountings, thus red the effort required to retract the lower clamping plate 140 and container located thereon into cabinet 18. Accordingly, significant forces can be generated when an operator pushes the lower clamping plate to its retracted, locked position. Over time, operation of the lock can become sloppy due to repeated impact upon retracting the lower clamping plate. It has therefore been found desirable to provide an adjustment for the lower clamping plate lock so that it can be quickly and easily adjusted to bring the axis of rotation of the upper and lower clamping plates 124, 140 into alignment with one another, as may be desirable from time to time.

With additional reference to FIG. 9, a shaft 144 is located underneath the lower clamping plate 140. A handle 146 is located at the forward end of the shaft 144; and a hooked, locking end is located at the rearward end 148 of shaft 144, opposite the handle 146. With reference to FIG. 9, the hooked locking end is preferably formed by notching the rearward end 148 of shaft 144 at 150. The shaft 144 is pivotally mounted at 152 so that the rearward end can be deflected in upward and downward directions. The rearward end 148 includes a beveled tip portion 154 which cams across the exposed surface of a striker plate 160. As the lower clamping plate 140 is moved into cabinet 18 to a fully retracted position, the beveled tip 154 cams across the edge of striker plate 160, deflecting the rearward end of shaft 144 in a downward direction with continued rearward movement of the lower clamping plate 140 and of the shaft 144 carried thereon, the notch portion 150 is brought into alignment with the striker plate 160 and is biased upwardly against the striker plate, thus securely locking the lower clamping plate 140 against horizontal movement. In the preferred embodiment, the shaft 144 is made of sufficiently resilient material so as to provide a significant downward bias force for urging the notched portion of the shaft into engagement with the striker plate. A screw fastener 156 allows adjustment of striker plate 160 back and forth in the direction of arrow 162. If desired, a spring 164 may be employed to bias the shaft 144 in a clockwise direction, as viewed in FIG. 9.

As mentioned, the clamping plates 124, 140 are mounted for movement toward and away from each other with operation of lead screw 92. Hub 94 is threadingly engaged with lead screw 92, and travels back and forth along guide rails 90, disposed on either side of lead screw 92. Hub 94 includes gear mechanism for driving spindle 112, and in turn, pulley 114 and the upper clamping plate 124. The guide rails 90 are affixed to hub 94 as is the spindle 112, and do not move in axial directions.

Referring to FIG. 4, the upper clamping plate 124 is secured to table 110, and table 110 is free to slide along guide rails 90. The table 110 includes a body part 170 which, in effect, increases the length of guide rails 90 which are engaged by the moving table assembly, thus adding to the rigidity and strength of the cantilever mounting of the upper clamping plate and its related components which travel back and forth along guide rails 90. The body part 170 and/or the table 110 are threadingly engaged with a first end of lead screw 92, the upper end as viewed in the rest or parked position illustrated in FIGS. 2 and 3. As the lead screw 92 is rotated in opposite directions, table 110 and the components related thereto travel back and forth along guide rails 90. Referring to FIG. 5, the components which travel back and forth along with table 110 can be seen as everything in FIG. 5 beneath the lock mechanism 98, except, of course, for the guide rails 90, lead screw 92 and spindle 112. The components which travel back and forth with table 110 are therefore seen to include the body part 170, clamping plate 124, pulley 116, shaft 120, idler pulley 128, and pulley 114, as well as the belt 118 mounted on the pulleys 114, 116, and table 110 itself.

Figure 7:
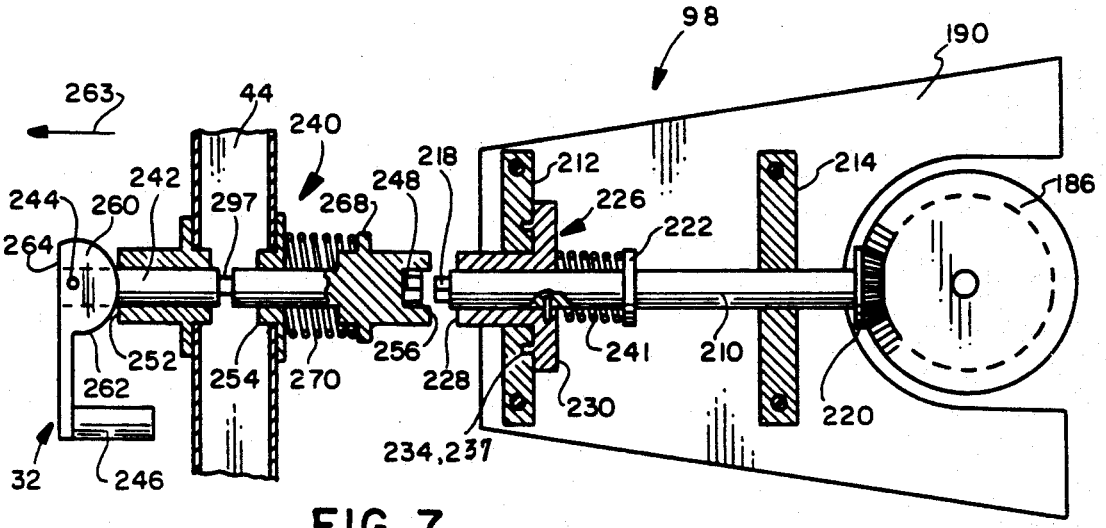
FIGS. 7 and 8 are fragmentary, side elevational views, shown partly in cross-section, of the locking mechanism of FIG. 4.

Referring now to FIGS. 2–8, the lock mechanism 98 will now be described in greater detail. Referring to FIG. 5, a bevel gear 186 is located at the upper free end of lead screw 92 and, as will be seen herein, provides a rotational drive for the lead screw. The lock mechanism 98, as will be seen herein, drives gear 186, preferably with a manual crank handle operator and a two-part transmission shaft which also locks lead screw 92 in a fixed position, preventing opening of the clamping plates 124, 140 during a mixing operation. The table 190 has a forward end 192 and a rearward end 194. Spacer members 196 and a support bar 198 are employed for mounting to the upper free end of guide rails 90 using the aforementioned threaded fasteners 104 received in threaded bore 106 of the guide rails. Table 190 includes a rounded opening 200 to provide clearance for the bevel gear 186 which is located generally at or above the upper surface of table 110. A shaft 210 is rotationally mounted at its forward and rearward ends with stationary mounting blocks 212, 214, respectively, which are secured to table 190 with threaded fasteners. With reference to FIG. 7, the forward end of shaft 210 is provided with an hexagonal tip 218, resembling the head of a machine bolt. The opposite, rearward end of shaft 210 is provided with a bevel gear 220 for mating with gear 186. Thus, as shaft 210 is rotated in opposite directions, lead screw 92 is rotated in opposite directions, owing to the mating engagement of gears 186, 220. Preferably, the gears 186, 220 remain engaged at all times. As will be see herein, shafts 210, 242 comprise first and second parts of a transmission shaft for driving gear 186 with handle 32.

Referring to FIGS. 5 and 7, a support ring 222 is fixed to shaft 210. Support ring 222 may comprise, for example, an E-ring. A movable locking member or flanged bushing 226 is slidably mounted at the forward end of shaft 210, but is keyed to the shaft for rotation therewith. The bushing has a forward end 228 which extends beyond block 212, located adjacent the hexagonal tip 218 of shaft 210. A flange 230 is located at the opposite end of bushing 226 and has an enlarged diameter so as to overlie substantial portions of mounting block 212. A series of locking pins 234 are mounted to flange 230 and are receivable in a series of apertures 237 formed in the major surface of mounting block 212 facing toward the gears 186, 220. A coil spring 241 biases the bushing 226 so that the flange portion 230 thereof is urged toward mounting block 212, so as to bias the locking pins 234 into engagement with the apertures 237 of the mounting block.

Mounting block 212 functions as a stationary lock member, so that with the pins received in the apertures of the mounting block 212, as illustrated in FIG. 7, shaft 210 is locked against rotational displacement and, owing to the engagement of gears 186, 220, lead screw 92 is also locked against rotational movement. If desired, the pins could be carried by block 212 with bushing 226 having apertures or peripheral recesses for engaging the pins. It is preferred when operating the mixing apparatus, that the clamping plates firmly engage a container, with the shaft 210 being locked, as illustrated in FIG. 7., so that the clamping plates will thereby be locked against loosening or separation during a mixing operation. As mentioned above, the guide rails 90 are mounted for rotation in the common plane of the guide rails, which is preferably a vertical plane. The table 110 and components associated therewith, described above with reference to FIG. 5, as well as the components illustrated in FIG. 9, will rotate with guide rails 90 about a rotational axis preferably located at the center of hub 94.

Figure 8:
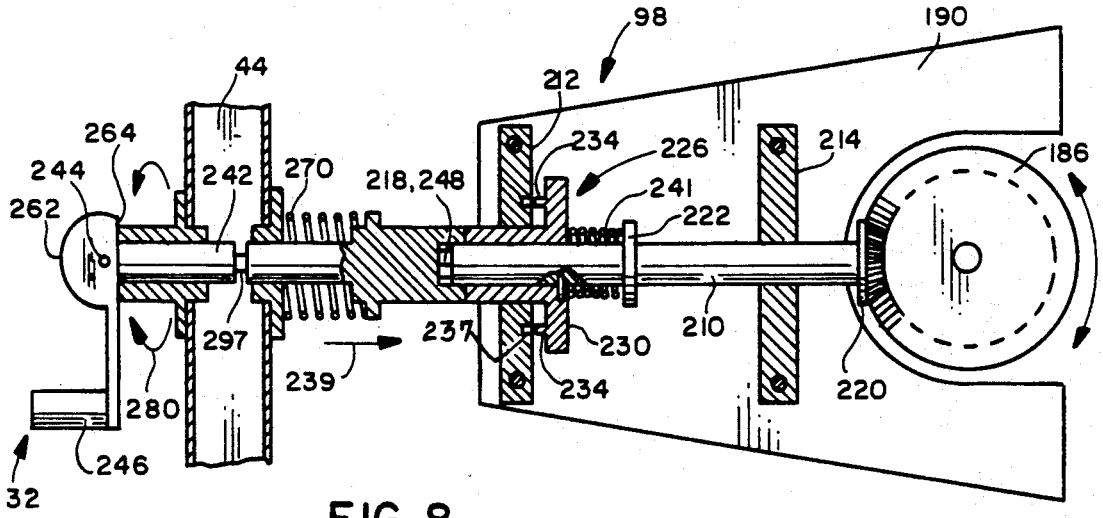

With reference to FIGS. 2–8 and especially to FIGS. 7 and 8, a manually-operated crank assembly generally indicated at 240, will now be described. Crank assembly 240 includes a stub shaft 242 having a forward end pinned at 244 to handle 32 and a rearward end with a hexagonal recess 248 for mating engagement with the hexagonal tip 218 of shaft 210, and a free end 256 engageable with the end 228 of bushing 226, in the manner illustrated in FIG. 8. Assembly 240 further includes flanged bushings 252, 254.

Handle 32 includes a cam portion 260 having a lobe surface 262 and a flat surface 264. FIG. 7 shows the lobe surface 262 in engagement with the forward end of bushing 252 and FIG. 8 shows the flat surface 264 in engagement with the same end of the bushing. The shaft 242 further includes a flange portion 268 holding a coil spring 270 captive between the flange portion and the upper support 44. FIG. 1 shows the handle 32 in a stowed position, with the handle received in an aperture 274. formed in cabinet 18. This corresponds to the illustration of FIG. 7, wherein the lobe surface 262 is in contact with the forward end of bushing 252. As the handle 32 is moved to the position of FIG. 7, stub shaft 242 is drawn in the forward direction of arrow 263, causing the rearward, recessed portion 248 to be spaced from the tip 218 of shaft 210, thus providing a clearance for the lock mechanism 98 to rotate about the central axis of hub 94.

When the handle is moved to the position of FIG. 8, with bushing 252 engaging the flat surface 264 of the handle, stub shaft 242 is moved in the direction of arrow 239, into engagement with shaft 210, with resulting mating engagement of extension 218 and hexagonal recess 248. The coil spring 270 urges the mating engagement of tip 218 and recess 248. When handle 32 is moved to the position illustrated in FIG. 8, mating of tip 218 and recess 248 is accomplished as described above, and additionally, the lock pins 234 carried on flange 230 of bushing 226 are disengaged from mounting block 212, thereby freeing shaft 210 for rotational movement. With operation of the manually engageable portion 246, the stub shaft 242 is rotated in the direction of arrow 280, which also causes shaft 210 and lead screw 92 to undergo rotation.

As can now be seen, FIG. 8 shows operation of the apparatus during a loading or unloading step, wherein the clamping plates 124, 140 are moved either toward or away from one another. During these steps, the guide rails 90 and equipment associated therewith are held in a fixed stationary position illustrated in FIGS. 2 and 3. After a container is located in apparatus 10 and the clamping plates are advanced to engage the container with a suitable clamping pressure, the handle 32 is moved to the position illustrated in FIG. 7 where the crank assembly 240 is withdrawn, free and clear of the locking mechanism 98 and at the same time shaft 210 is locked against rotational displacement, thereby maintaining the clamping plates in a fixed position despite centrifugal forces during a mixing operation, when the clamping plates are spun about the central axis of hub 94.

Operation of mixing apparatus 10 will now be described. Apparatus 10, as illustrated in FIG. 1, is empty and ready to receive a container, such as a paint can, to be mixed. Access door 20 is opened and handle 146 is raised in the direction of arrow 147 (see FIG. 9) to unlock the lower clamping plate 140 for sliding in a forward direction of arrow 149 to facilitate loading of the container down to the clamping plate. As indicated in FIG. 1, the clamping plates are moved apart from one another so that the lower clamping plate with the container resting thereon can be moved to the retracted position illustrated in FIGS. 1 and 2, for example, with the lock mechanism for the clamping plate engaged in the manner indicated in FIG. 9. At this point in the operation, the clamping plates 124, 140 are aligned along a common central axis, the aforementioned secondary axis of rotation. The handle 32 from the cabinet aperture 274, illustrated in FIGS. 1 and 7, to the operating position illustrated in FIGS. 2 and 8.

A cranking motion applied to the manually engageable part 246 of handle 32 rotates inter-engaging shafts 242, 210 so as to apply a rotational force to lead screw 92 through meshed gears 186, 220, thus causing the lead screw 92 to rotate in the, other direction which causes the clamping plates 140 to move away from each other. The cranking is continued until a desired clamping pressure is applied to the container. Thereafter, the handle 32 is moved from the position illustrated in FIGS. 2 and 8, to the stowed position illustrated in FIGS. 1 and 7.

Figure 10:
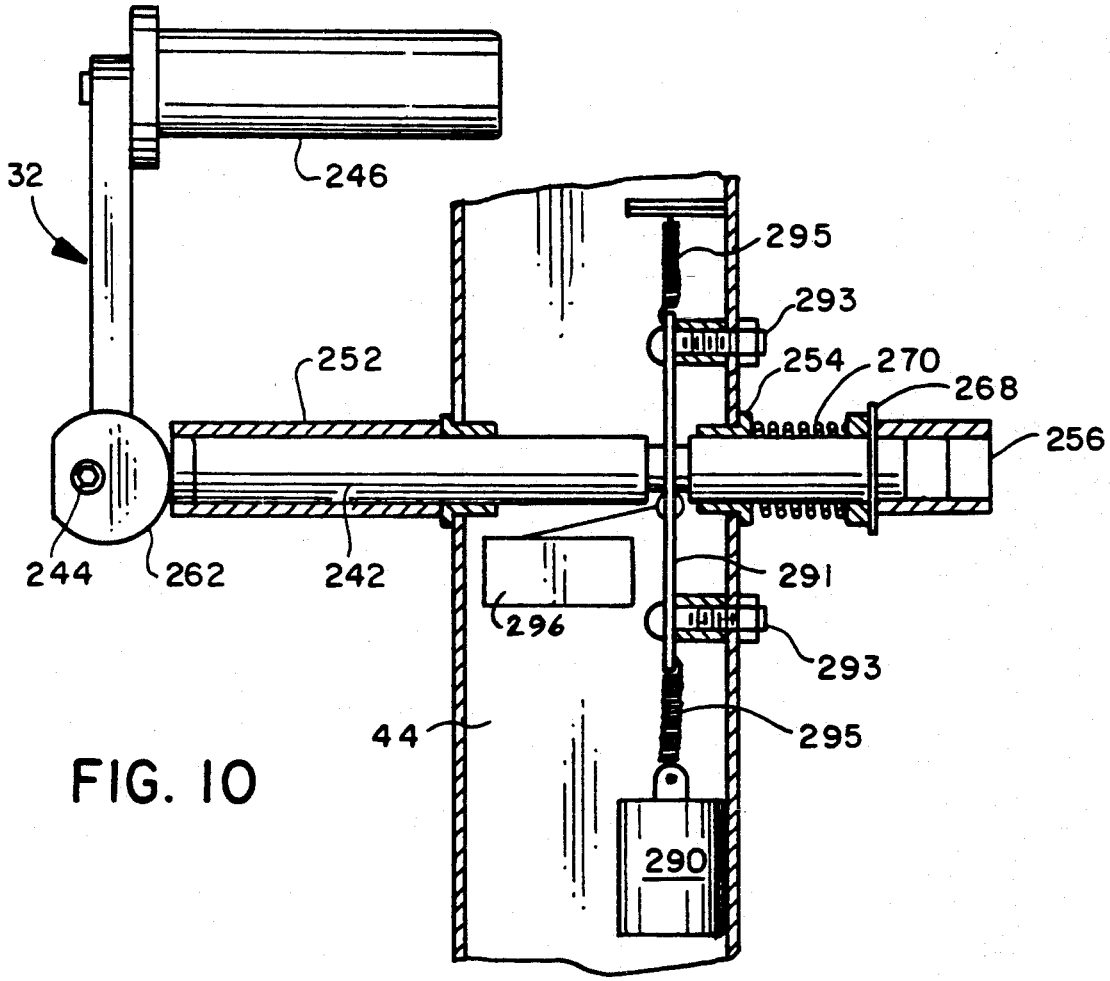
FIG. 10 is an enlarged view of the mechanism of FIG. 7.

The mixing mechanism 80, including guide rails 90, the clamping plates 124, 140 and related equipment as described above, is free to rotate about the central axis of hub 94, the primary axis of rotation. As explained above with reference to FIG. 7, the shaft 210 is locked in its angular position, thereby preventing rotation of lead screw 92. Controls on panel 30 are then operated to initiate a mixing cycle. Included in the mixing cycle is the energizing of a solenoid 290 (see FIG. 10) through signals applied to/control wires 292 to extend the solenoid plunger 294 into engagement with lock plate 291 slidingly mounted to support 44 by pins 293. The lock plate is biased by spring 295 out of engagement with annular recess 297 of shaft 242 (see FIG. 8). This provides added security, and shaft 242 remains clear of the rotating mixing mechanism. The electric motor 56 is then energized to drive belt 78 which is coupled to a large diameter pulley 79, as illustrated in FIG. 3. The pulley 79 is coupled to a shaft, not shown, to hub 94, extending along the central axis of hub 94. If desired, an electrical switch 296 can be employed (see FIG. 10) to sense the position of recess 297, and to override control of motor 56 if shaft 242 is not clear of the rotating mechanism.

A gear train operated off the drive shaft connected to pulley 79 drives spindle 112 at a desired preselected rotational speed. This in turn drives the upper clamping plate 124 at a desired rotational speed for spinning of the container along a minor axis corresponding to the common axis through the centers of clamping plates 124, 140. Thus, with a single electric motor, a container to be mixed is simultaneously rotated along two non-coincident, preferably orthogonal axes.

After the mixing cycle is completed, motor 56 is de-energized, allowing the spinning mechanism 80 to coast to a stop. In the preferred embodiment, a solenoid, not shown, engages the mixing mechanism, preferably the hub 94, as the mechanism coasts to a stop so as to stop the clamping plate 124 in the upper position illustrated in FIGS. 1–3. The lock mechanism 98 is then aligned with the crank assembly 240, such that the shafts 242, 210 are aligned along a common central axis, but are spaced apart in the manner illustrated in FIG. 7. Thereafter, the handle 32 is moved to the operating position illustrated in FIG. 8, with the handle applying a torque to the lead screw 92 which is free to rotate with the disengagement of locking pins 234 from block 212. The handle 32 is cranked in a direction to separate the clamping plates, relieving the clamping pressure from the container. The access door 20 is again opened and handle 146 is moved in an upward position allowing the handle and the lower clamping plate 140, with the container resting thereon, to be slid in an outward direction, allowing the container to be removed from apparatus 10. At this point, apparatus 10 is ready to receive another container, with mixing operation begun anew.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Mixing apparatus for pulverulent materials having a forward end for loading items to be mixed and a rearward end, comprising:

guide rod means extending in a first plane;

first rotating means for rotating the guide rod means in the first plane;

a pair of opposed pressure plates having centers;

slidable mounting means carried by said guide rod means for cantilever mounting of the pressure plates so as to align said pressure plates along a common axis generally parallel to said first plane and passing generally through the centers of the pressure plates, and so as to mount said pressure plates for sliding movement toward each other to engage and retain a container filled with the pulverulent materials during a mixing operation and said pressure plates movable away from each other to release the container;

second rotating means for rotating said pressure plates and container about the common axis while said pressure plates, guide rod means and container are rotated in the first plane;

electric motor means for driving at least one of said first and said second rotating means;

operator means including screw shaft means threadingly engageable with said pressure plates for moving said pressure plates toward and away from each other as said screw shaft means is rotated in opposite directions, and a transmission shaft for rotational drive of said screw shaft means; and pressure plate locking means engageable with said transmission shaft to prevent rotation of said screw shaft means to lock said pressure plates in a desired position, said pressure plate locking means including a locking plate keyed to said transmission shaft for movement along a central axis of said transmission shaft between a locked position preventing rotation of said transmission shaft and an unlocked position where said transmission shaft is free to rotate.

2. The apparatus of claim 1 wherein said locking means further comprises a stationary lock member adjacent said transmission shaft and engaged by said locking plate when said locking plate is moved to said locked position.

3. The apparatus of claim 2 wherein said locking means further comprises locking pins carried on at least one of said movable locking member and said stationary lock member engageable with the other of said movable locking member and said stationary lock member.

4. The apparatus of claim 3 wherein said locking pins are carried on said movable locking member and said stationary lock member defines apertures for receiving said locking pins so as to prevent rotation of said transmission shaft.

5. The apparatus of claim 2 wherein said locking means further comprises means for biasing said movable locking member into engagement with said stationary lock member.

6. The apparatus of claim 5 wherein said transmission shaft is comprised of first and second parts coaxially aligned end-to-end, with the second part carrying the movable locking member and the first part movable toward and away from, into and out of engagement with, the second part.

7. The apparatus of claim 6 wherein said first transmission shaft part engages said movable locking member to move said movable locking member out of engagement with said stationary lock member when engaging said second transmission shaft part.

8. The apparatus of claim 7 wherein said locking pins are carried on said movable locking member and said stationary lock member defines apertures for receiving said locking pins so as to prevent rotation of said second transmission shaft part.

9. The apparatus of claim 6 wherein said locking means further comprises lock actuating means for moving said first transmission shaft part into and out of engagement with the second transmission shaft part, said lock actuating means including cam means coupled to said first transmission shaft part and movable between first and second positions with said first and second transmission shaft parts engaged and disengaged from one another, respectively.

10. The apparatus of claim 9 further comprising manually engageable handle means coupled to said first transmission shaft part for rotational driving of said transmission shaft, and said cam means is carried on said handle means.

11. The apparatus of claim 10 further comprising means for biasing said first and second transmission shaft parts into engagement with one another.

12. Mixing apparatus for pulverulent materials having a forward end for loading items to be mixed and a rearward end, comprising:

guide rod means extending in a first plane;

first rotating means for rotating the guide rod means in the first plane;

a pair of opposed pressure plates having centers aligned along a common axis generally parallel to said first plane and passing generally through the centers of the pressure plates, said pressure plates carried on said guide rod means so as to be movable toward and away from each other in directions generally parallel to said common axis, said pressure plates receiving therebetween a container carrying the pulverulent materials and holding the container during a mixing operation when moved together so as to engage the container;

second rotating means for rotating said pressure plates and container about the common axis while said pressure plates, guide rod means and container are rotated in the first plane;

tubular frame means enclosing a three dimensional volume disposed about said guide rod means and said pressure plates to shield the guide rod means and pressure plates from inadvertent contact, said tubular frame means, including a back portion, at the rearward end of the apparatus, with an upper part protruding above said guide rod means and said pressure plates;

electric motor means for driving at least one of said first and said second rotating means;

mounting means for mounting said electric motor means at the upper part of the tubular frame means;

sliding means for slidably mounting one said pressure plate for movement away from said guide rod means for loading of a container to be mixed thereon and toward the guide rod means to align the one pressure plate with the common axis in preparation for a mixing operation; and lock means for locking the one pressure plate in alignment with the common axis, said lock means comprising a lock member carried on said one pressure plate and a striker plate supported by said guide rod means and means for adjusting the position of said striker plate to align said one pressure plate with the common axis.

13. The apparatus of claim 12 wherein said lock member comprises a double ended shaft having a medial portion pivotally mounted to said one pressure plate, a first manually engageable end and a second end for engaging said striker plate.

14. The apparatus of claim 13 wherein said second end has hook means for engaging said striker plate and an adjacent cam portion for bringing the hook means into engagement with said striker plate.

15. Mixing apparatus for pulverulent materials having a forward end for loading items to be mixed and a rearward end, comprising:

guide rod means extending in a first plane;

first rotating means for rotating the guide rod means in the first plane;

a pair of opposed pressure plates having centers aligned along a common axis generally parallel to said first plane and passing generally through the centers of the pressure plates, said pressure plates carried on said guide rod means so as to be movable toward and away form each other in directions generally parallel to said common axis, said pressure plates receiving therebetween a container carrying the pulverulent materials so as to hold the container during a mixing operation when moved together so as to engage the container;

second rotating means for rotating said pressure plates and container about the common axis while said pressure plates, guide rod means and container are rotated in the first plane;

tubular frame means enclosing a three dimensional volume disposed about said guide rod means and said pressure plates to shield the guide rod means and pressure plates from inadvertent contact, said tubular frame means including a back portion, at the rearward end of the apparatus, with an upper part protruding above said guide rod means and said pressure plates;

electric motor means for driving at least one of said first and said second rotating means;

mounting means for mounting said electric motor means at the upper part of the tubular frame means;

sliding means for slidably mounting one said pressure plate for movement away from said guide rod means for loading of a container to be mixed thereon and toward the guide rod means to align the one pressure plate with the common axis in preparation for a mixing operation; and lock means for locking the one pressure plate in alignment with the common axis, said lock means comprising a lock member carried on said one pressure plate and a striker plate supported by said guide rod means and means for adjusting the position of said striker plate to align said one pressure plate with the common axis.

16. Mixing apparatus for pulverulent materials having a forward end for loading items to be mixed and a rearward end, comprising:

guide rod means extending in a first plane;

first rotating means for rotating the guide rod means in the first plane;

a pair of opposed pressure plates having centers aligned along a common axis generally parallel to said first plane and passing generally through the centers of the pressure plates, said pressure plates carried on said guide rod means so as to be movable toward and away from each other in directions generally parallel to said common axis, said pressure plates receiving therebetween a container carrying the pulverulent materials so as to hold the container during a mixing operation when moved together so as to engage the container;

second rotating means for rotating said pressure plates and container about the common axis while said pressure plates, guide rod means and container are rotated in the first plane;

tubular frame means enclosing a three dimensional volume disposed about said guide rod means and said pressure plates to shield the guide rod means and pressure plates from inadvertent contact, said tubular frame means including a back portion, at the rearward end of the apparatus, with an upper part protruding above said guide rod means and said pressure plates;

electric motor means for driving at least one of said first and said second rotating means; and mounting means for mounting said electric motor means at the upper part of the tubular frame means including a double-ended mounting plate having a first end cantilevered from the upper part of the tubular frame means and having an unsupported, free, second end spaced from the upper part and said mounting means also including means for attaching said electric motor means to said plate, with the mounting plate providing a resilient mounting for the electric motor means to thereby absorb impulse shock associated with said electric motor means.

* * * * *

UNITED STATES PATENT AND TRADEMARK OFFICE

CERTIFICATE OF CORRECTION

PATENT NO. : 5,197,802

DATED : March 30, 1993

INVENTOR(S) : Miller et al.

It is certified that error appears in the above-indentified patent and that said Letters Patent is hereby corrected as shown below:

Column 5, line 35, delete "red" and substitute --reducing--.

Column 8, line 55, after "32" insert --is withdrawn--.

Column 8, line 62, after "the" delete ",".

Column 8, line 63, after "plates" insert --124,--.

Column 9, line 10, change "to/control" to --to control--.

Column 11, line 50, after "means" delete ",".

Signed and Sealed this

Eighteenth Day of April, 1995

Bruce Lehman

*Attest:*

BRUCE LEHMAN

*Commissioner of Patents and Trademarks*

*Attesting Officer*